US009523513B2

(12) United States Patent
Jourdain et al.

(10) Patent No.: US 9,523,513 B2
(45) Date of Patent: Dec. 20, 2016

(54) HEATING SYSTEM FOR A THERMAL ELECTRIC POWER STATION WATER CIRCUIT

(71) Applicant: ALSTOM Technology Ltd, Baden (CH)

(72) Inventors: Vincent Jourdain, Paris (FR); Jerome Colin, Noisy le Roi (FR)

(73) Assignee: General Electric Technology GmbH, Baden (CH)

( * ) Notice: Subject to any disclaimer, the term of this patent is extended or adjusted under 35 U.S.C. 154(b) by 419 days.

(21) Appl. No.: 13/744,477

(22) Filed: Jan. 18, 2013

(65) Prior Publication Data

US 2013/0188939 A1 Jul. 25, 2013

(30) Foreign Application Priority Data

Jan. 19, 2012 (FR) ..... 12 50548

(51) Int. Cl.
*F24H 1/00* (2006.01)
*F22D 1/32* (2006.01)
(Continued)

(52) U.S. Cl.
CPC ..... *F24H 1/0018* (2013.01); *F01K 7/16* (2013.01); *F01K 7/40* (2013.01); *F22B 1/023* (2013.01); *F22D 1/325* (2013.01)

(58) Field of Classification Search
CPC ..... F22D 1/325; F24H 1/0018; F22B 1/023; F01K 7/16; F01K 7/40
(Continued)

(56) References Cited

U.S. PATENT DOCUMENTS 3,016,712 A 1/1962 Taylor
3,061,533 A * 10/1962 Shannon et al. ..... 376/219
(Continued)

FOREIGN PATENT DOCUMENTS

CN 1218537 A 6/1999
CN 201652318 U 11/2010
(Continued)

OTHER PUBLICATIONS

French Patent Office, Search Report in French Patent Application No. 1250548 (Nov. 5, 2012).

*Primary Examiner* — Gregory Huson
*Assistant Examiner* — Daniel E Namay
(74) *Attorney, Agent, or Firm* — Global Patent Operation; Cynthia W. Flanigan

(57) ABSTRACT

A heating system for a thermal electric power station water circuit includes an extraction system for extracting water from a condenser and a first set of heaters including a first water inlet fed with a first fraction of a flow coming from the extraction system, and a input for heating the extracted water. A second set of heaters includes a heater arranged in series with the extracted-water inlet of the first set, and a steam input for heating the extracted water. A condensate cooler includes a first water inlet fed by a condensate outlet of the second set of heaters, a second water inlet fed with a complementary fraction of the extracted-water flow, a first outlet for cooled condensate to be reinjected into the condenser, and a second outlet for heated water so that water leaving the first set of heaters is mixable with water from the second outlet.

6 Claims, 3 Drawing Sheets

(51) Int. Cl.

| | |
|---|---|
| ***F01K 7/16*** | (2006.01) |
| ***F01K 7/40*** | (2006.01) |
| ***F22B 1/02*** | (2006.01) |
| *F22B 1/08* | (2006.01) |

(58) Field of Classification Search

USPC ..... 126/210; 136/201, 205, 224; 237/55–66, 237/71; 290/52; 392/465; 60/645, 653, 654, 60/670, 690, 692; 62/238.6, 238.7, 324.1, 62/324.6

IPC ..... F22D 1/32; F24H 1/00; F22B 1/08,1/02; F01K 7/16, 7/14

See application file for complete search history.

(56) References Cited

U.S. PATENT DOCUMENTS

| | | | | |
|---|---|---|---|---|
| 3,155,547 | A * | 11/1964 | Siebker | 376/320 |
| 4,003,205 | A | 1/1977 | Matsumura | |
| 5,836,162 | A | 11/1998 | Jaynes | |
| 6,038,851 | A | 3/2000 | Shiba | |
| 8,959,917 | B2 * | 2/2015 | Berndt | F01K 7/22 60/652 |
| 2001/0004829 | A1 | 6/2001 | Liebig | |
| 2009/0266076 | A1 * | 10/2009 | Bellows | 60/657 |
| 2011/0094228 | A1 * | 4/2011 | Fan | F01K 7/22 60/679 |
| 2013/0205776 | A1 * | 8/2013 | Yin | F01K 25/10 60/615 |

FOREIGN PATENT DOCUMENTS

| | | | | |
|---|---|---|---|---|
| DE | 4134686 | A1 | | 4/1993 |
| DE | 4139140 | A1 | | 6/1993 |
| DE | 19853206 | C1 | | 3/2000 |
| EP | 2333254 | A1 | | 6/2011 |
| JP | 58107803 | A | * | 6/1983 |
| JP | 58107804 | A | * | 6/1983 |
| JP | 07145709 | A | * | 6/1995 |
| JP | 2005-091291 | A | | 4/2005 |
| RU | 2405942 | C2 | | 12/2010 |
| WO | 2010/086898 | A1 | | 8/2010 |

* cited by examiner

HEATING SYSTEM FOR A THERMAL ELECTRIC POWER STATION WATER CIRCUIT

CROSS REFERENCE TO RELATED APPLICATIONS

This application claims priority to French Patent Application No. 1250548, filed Jan. 19, 2012, which is hereby incorporated by reference herein in its entirety.

FIELD

The present invention relates to the field of heating systems for the water circuit of the water-steam cycle of thermal electric power stations.

BACKGROUND

The heating system of the invention applies notably to nuclear power stations and, in particular, to power stations provided with a boiling water reactor (BWR), but can also be applied to other types of thermal electric power station. The invention more particularly relates to the circuits for recovering heat between, on the one hand, the outlet of at least one condenser and, on the other hand, the inlet of a steam generator system of a power station.

In present-day thermal electric power stations optimizing the water heating circuit is of crucial importance, particularly as far as reducing energy costs are concerned.

The key problem is that it is necessary to convey a flow of water to the inlet of a steam generator system at a given temperature while at the same time making maximum reuse of the energy of the water in steam or condensed form at all stages of the treatments. The issue is therefore one of minimizing the losses of heat energy and of optimizing reuse in the overall operation of a power station.

It is necessary to consider various aspects when optimizing the energy efficiency of a thermal electric power station. In particular, a power station has a number of constraints on the structural integration of the various elements of which it is made up and this means that certain compromises have to be made.

In this regard, the choice of configuration imposes certain safety constraints between the various elements of a thermal electric power station. The safety/efficiency compromise sometimes leads to a loss of heat energy and/or of efficiency in the energy circuit.

FIG. 1 depicts a conventional design of a thermal electric power station comprising a steam generator system 1, a set of high-pressure turbines 8, a set of medium-pressure turbines 9, and a set of low-pressure turbines 10. There is conventionally also an alternator 11 and a condenser 6. A system provides a flow of cooling water to the condenser 6.

The steam generator system 1 and the high-pressure, medium-pressure and low-pressure turbines, the alternator 11, the external circulation circuit 300 and the condenser 6 make up the key elements of the primary circuit of a power station. In some instances, the medium-pressure and low-pressure turbines may be combined.

On the outlet side of the condenser 6, a circuit for extracting water condensed from water extracted from the condenser 6 by a pump 4 comprises a purification system 35, denoted SP, otherwise known as a "polishing system", followed by a heating circuit made up of several sets of heaters.

The principle relies on recovering some of the residual heat from the steam tapped off at chosen points in the turbine for the purposes of heating up the water fed to the steam generator system. The steam inlets 20, 21 and 23 allow the water of the circuit 30 to be heated up gradually to ensure a flow of water reinjected into the inlet side of the steam generator system 1 at the desired temperature.

The heaters LP1, LP2, LP3, LP4, the feed tank, denoted BA, and the group of heaters denoted HP are mounted in series with respect to the flow of water extracted from the condenser 6 so as to optimize the thermodynamic water-heating cycle. In a conventional configuration, a cooler 7, denoted RC, is positioned upstream of the heating circuit to cool condensate from the heater LP3 before it is returned to the condenser 6.

In a conventional way, for system architecture reasons, a first set of heaters is generally incorporated into a structure comprising the condenser 6 and the low-pressure turbine 10. In the example illustrated, this first set comprises the heaters LP1 and LP2.

A second set of heaters, comprising the heaters LP3 and LP4, is arranged generally outside of the structure comprising the condenser 6.

In general, prudent rules of design dictate that the condensate 100 coming from this second set cannot be recovered directly in the first set of heaters incorporated into a structure comprising the condenser 6 and the low-pressure turbine 10.

Because the condensate 100 coming from the second set of heaters cannot be conveyed directly to the first set, the conventional solution is to cool this condensate before returning it to the condenser 6, in order to avoid significant losses of heat energy.

In this type of configuration, the condensate 100 coming from the second set is injected into the cooler 7 in order to return colder water to the condenser 6 via the outlet 13 of the cooler 7.

There is, however, a significant loss in energy efficiency in the function of heating up the water in the circuit 30 because of the large temperature difference notably between the outlet of the cooler 200 and the return 100.

There are solutions that make it possible to maximize the energy balance when heaters are mounted in cascade. For example, one known alternative is to fit a condensate recovery pump recovering condensate from one particular heater and reinject it into the feedwater circuit downstream of that same heater. Such a system does indeed allow recovery directly in the water cycle at a similar temperature level, therefore maximizing energy efficiency by minimizing temperature differences. However, this solution has several potential disadvantages.

First of all, it adds additional equipment to the water system, particularly pumps, which have a cost, which require space in which to install them, and which demand a certain level of maintenance. Furthermore, the condensate pumped by a recovery pump does not pass through the purification system SP that purifies the water extracted from the condenser, thus reducing the chemical quality of the water in the circuit.

A second known alternative is systematically to cascade the condensate from one heater into the heater of lower rank. As discussed earlier, this solution cannot prudently be applied to heaters incorporated into a structure comprising the condenser 6 and the low-pressure turbine 10 because these tappings are not fitted with nonreturn valves and the backflow of a mixture of cold revaporized water and condensate to the turbine, notably in the event of a sudden sharp pressure drop, could lead to turbine blade damage.

Therefore, the configuration of fitting a drain cooler 7 upstream of the first set of heaters LP is generally the one adopted for reasons of reliability, ease of maintenance and water quality, to the relative detriment of energy efficiency.

SUMMARY OF THE INVENTION

The invention makes it possible to alleviate the above-mentioned disadvantages.

In an embodiment, the present invention provides a heating system for a thermal electric power station water circuit includes an extraction system for extracting water from a condenser and a first set of heaters including at least one heater, a first water inlet providing an extracted-water-for-heating inlet fed with a first fraction of a flow of extracted water coming from the extraction system, and at least one steam input for heating the extracted water. A second set of heaters includes at least one heater arranged in series with respect to the extracted-water inlet of the first set of heaters, and at least one steam input for heating the extracted water. The system includes a condensate cooler comprising a first water inlet providing a condensate inlet fed by a condensate outlet of the second set of heaters, a second water inlet fed with a complementary fraction of the extracted-water flow coming from the extraction system, a first outlet for cooled condensate that is configured to be reinjected into the condenser, and a second outlet for heated water so that a flow of water leaving the first set of heaters is mixable with a flow of water derived from the second outlet of the drain cooler.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. Elements that are identical or similar are identified by identical reference characters throughout the figures. The features and advantages of various embodiments of the present invention will become apparent by reading the following detailed description with reference to the attached drawings which illustrate the following.

DETAILED DESCRIPTION

Figure 1:
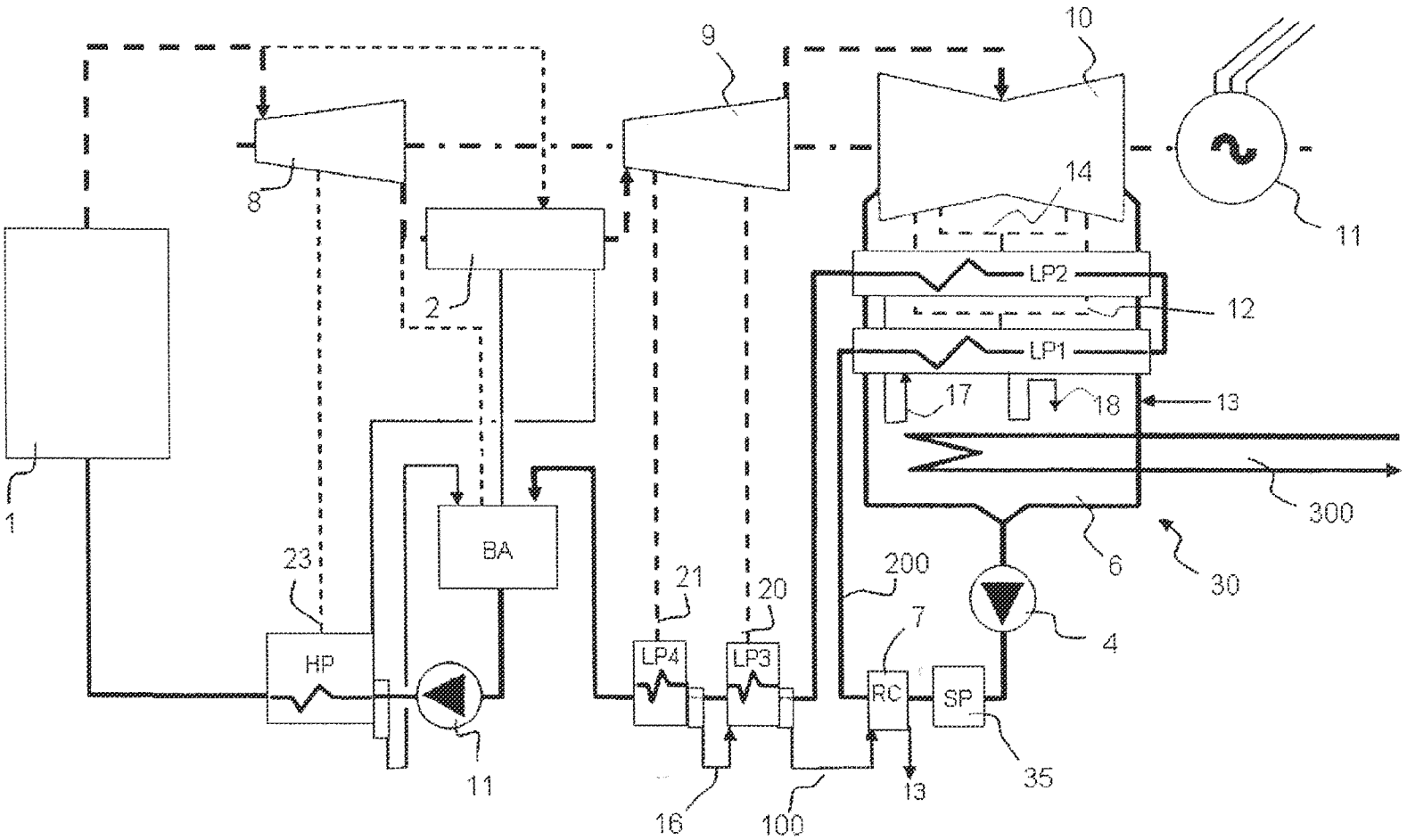
FIG. 1 shows a schematic diagram of a system of heaters of a water circuit for a thermal electric power station.

An aspect of the invention is to make available a system for heating the circuit of water to be conveyed to the steam generator system that allows an optimized energy balance while at the same time guaranteeing maximum level of safety for the turbine, minimum maintenance effort and the possibility of best chemical quality of the feedwater.

The invention relates to a heating system for a thermal electric power station water circuit, comprising:

- an extraction system for extracting water from a condenser;
- a first set of heaters comprising:
  - at least one heater,
  - a water inlet, referred to as the extracted-water-for-heating inlet, fed with a first fraction of the flow of extracted water coming from the extraction system, and
  - at least one steam input intended to heat the extracted water, and;
- a second set of heaters comprising:
  - at least one heater arranged in series with respect to the extracted-water inlet of the first set of heaters, and
  - at least one steam input intended to heat the extracted water the heating system being one which comprises a condensate cooler comprising:
- a first water inlet, referred to as the condensate inlet, fed by a condensate outlet of the second set of heaters;
- a second water inlet fed with a complementary fraction of the extracted-water flow coming from the extraction system;
- a first outlet for cooled condensate intended to be reinjected into the condenser, and;
- a second outlet for heated water so that a flow of water leaving the first set of heaters can be mixed with a flow of water derived from the second outlet of the drain cooler.

This "in-parallel" configuration of the equipment makes it possible to reduce the flow of extracted water passing through the first set of heaters and thus minimize the flow of steam needed to heat up the extracted water in the first set of heaters.

Specifically, by comparison with the prior art, such a configuration allows the flow of extracted water coming from the extraction system to be split into a first fraction feeding, via its water inlet referred to as the extracted-water-for-heating inlet, the first set of heaters and a complementary fraction feeding, via its second water inlet, the condensate cooler of the second set of heaters.

The term "complementary" means that the sum of these fractions represents 100% of the flow of extracted water coming from the extraction system.

Such a feature notably makes it possible to reduce the flow of tapped-off steam needed for heating the extracted water in the first set of heaters, the reduction being justified by the fact that the first fraction represents less than 100% of the flow of extracted water coming from the extraction system.

On the other hand, such a feature allows the condensate cooler to be fed with a complementary fraction less than 100% of the flow of extracted water coming from the extraction system, this complementary fraction making it possible, at its second, heated water, outlet, to supply water at a temperature higher than is achieved by the existing devices.

According to another advantageous feature, the heating system comprises means 'R' for regulating the flow of water coming from the extraction system to allow adjustment of the complementary fraction of the flow of water fed to the cooler.

Specifically, this complementary fraction allows the flow of water fed to the cooler to be adjusted optimally in order to obtain optimized ultimate efficiency of the thermal electric power station.

Advantageously, the complementary fraction of the flow of water fed to the cooler represents, in percentage terms, between 2 and 20%, and preferably between 5 and 15%, of the flow of water coming from the extraction system.

Specifically, it has been noted with surprise that such values make it possible to obtain a heated water temperature at the second outlet of the condensate cooler which is at a temperature close to that of the water leaving the first set. Mixing these two flows at similar temperatures makes it possible to reduce irreversibility losses and to optimize the overall efficiency of the thermal electric power station.

According to one particular technical aspect, the first set of heaters comprises at least one first heater and one second heater which are arranged in cascade so that a fraction of the water heated up by the steam introduced into the second heater is reinjected either into the first heater or into the condenser.

According to another particular technical aspect, the second set of heaters comprises at least one third heater and one fourth heater arranged in cascade such that a fraction of the condensate from the steam introduced into the fourth heater is reinjected into the third heater.

Advantageously, a polishing setup is arranged between the extraction system extracting water from the condenser and the inlet of the first set of heaters so as to filter out particles present and trap salts dissolved in the water that is to be heated in the water circuit.

The invention also relates to a thermal electric power station which comprises a system for heating a water circuit, said water circuit heating system comprising:

- an extraction system for extracting water from a condenser;
- a first set of heaters comprising:
  - at least one heater,
  - a water inlet, referred to as the extracted-water-for-heating inlet, fed with a first fraction of the flow of extracted water coming from the extraction system, and
  - at least one steam input intended to heat the extracted water, and;
- a second set of heaters comprising:
  - at least one heater arranged in series with respect to the extracted-water inlet of the first set of heaters, and
  - at least one steam input intended to heat the extracted water;

the heating system being one which comprises a condensate cooler comprising:

- a first water inlet, referred to as the condensate inlet, fed by a condensate outlet of the second set of heaters;
- a second water inlet fed with a complementary fraction of the extracted-water flow coming from the extraction system;
- a first outlet for cooled condensate intended to be reinjected into the condenser, and;
- a second outlet for heated water so that a flow of water leaving the first set of heaters can be mixed with a flow of water derived from the second outlet of the drain cooler.

In the remainder of the description, when a plurality of heaters is said to be "mounted in series" that means that the water outlet from one heater is fed, at least in part, to the inlet of another heater. In the description which follows, mention will be made of heaters mounted in series with respect to the flow of water coming from the water extraction system 4. A first heater may be said to be situated upstream of a second heater when it treats the water coming from the extraction system before the second heater.

In the remainder of the description, when a plurality of heaters is said to be "mounted in cascade" that means that they are mounted in series and that some of the condensate from a second heater situated downstream of a first heater is reinjected into the first heater and mixed with the water outlet thereof.

In the remainder of the description, a condensate cooler will be termed a "cooler". A flow of water condensed from the steam of the cycle will also be referred to as condensate.

Figure 2:
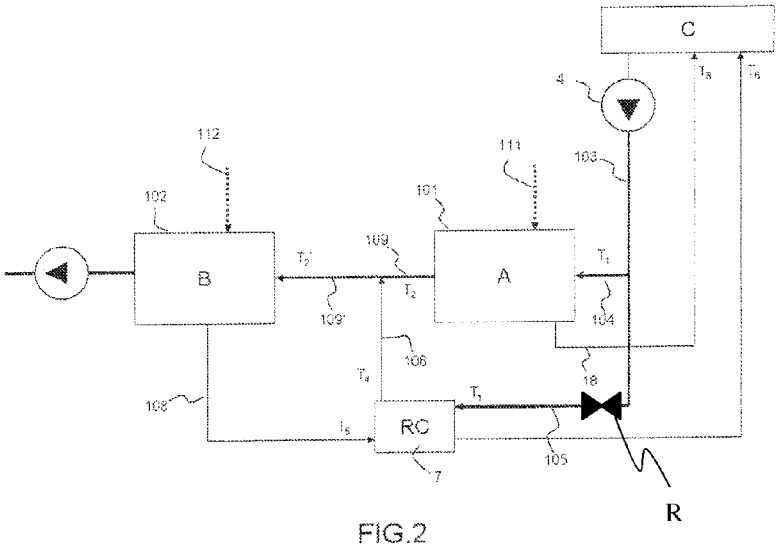
FIG. 2 shows a schematic diagram of a system of heaters of a water circuit of the invention.

FIG. 2 depicts a heating system of a thermal electric power station water circuit comprising a first set 101 of heaters, denoted A, which can be used to heat a flow of water 104 to an inlet temperature T1. The flow of water 104 at the inlet of the first set 101 of heaters comes from an extraction system 4 extracting water at the outlet from a condenser C delivering a flow of water 103 at a temperature T1 substantially equal to the inlet temperature.

Figure 3:
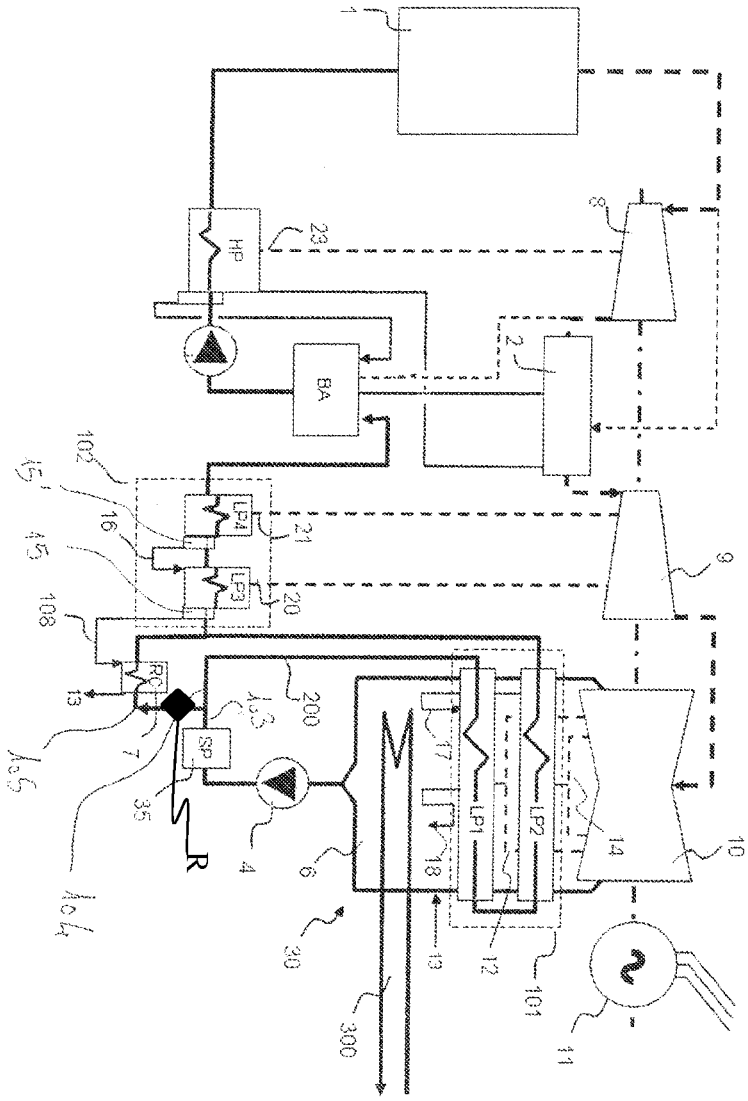
FIG. 3 shows a schematic diagram of one embodiment of the invention of a system of heaters of a water circuit.

The first set 101 of heaters comprises a plurality of heaters in a cascade architecture. In the example of FIG. 3, the first set of heaters comprises two heaters LP1, LP2 in cascade.

A heater is a device that allows the water to be heated by heat transfer. This exchange of heat takes place between, on the one hand, a flow of steam 111 entering the first set of heaters which condenses in the device and reemerges from the device via an outlet 18, and, on the other hand, the flow of water 104 coming from the water extraction system 4 at the temperature T1 that this heat heats up to the temperature T2 of the circuit 109.

The first set 101 of heaters delivers a flow of heated water 109 at a temperature T2 to the inlet of a second set 102 of heaters, denoted B. The second set 102 of heaters heats a flow of water at inlet 109' to an inlet temperature T2' thanks to an exchange of heat with a flow of steam 112 entering the second set 102 which condenses and reemerges from the set B at outlet 108.

The first set 101 of heaters and the second set 102 of heaters are arranged in series with respect to the flow of water coming from the water extraction system.

The heating system of the invention comprises a cooler 7, denoted RC, external to the two sets of coolers and arranged in parallel with the first set of heaters with respect to the flow of water coming from the extraction system 4. This is a condensate cooler used to cool the condensate 108 from the second set 102 of heaters.

The flow of water coming from the extraction system 4 is split into a first fraction 104 conveyed to the first set 101 of heaters and a complementary fraction 105 conveyed to the cooler 7.

The term "complementary" means that the sum of these fractions represents 100% of the flow of extracted water coming from the extraction system.

The apportioning of the flow of water is determined by balancing the pressure drops across the two circuits.

The cooler 7 comprises a second water inlet 108 coming from condensate from the second set 102 of heaters. The cooler comprises a heat exchanger used to heat the complementary fraction 105 from the temperature T1 to a temperature T4 by cooling the flow 108 from the temperature T5 to the temperature T6.

The flow 106 at the temperature T4 is mixed with the flow 109 at the temperature T2 to form the flow 109' at the temperature T'2 which constitutes the inlet of the second set 102 of heaters. The complementary fraction 105 can be adjusted so as advantageously to obtain a temperature T4 close to T2, this making it possible to limit irreversibility losses, it being understood here that the term "close to" means a difference of plus or minus 5 degrees Celsius.

Thus, the condensate 108 from the second set 102 of heaters can be used to heat up the flow of water 105 coming from the water extraction system 4 without it passing through the first set 101 of heaters. This solution allows some of the heat energy of the condensate of a second set 102 of heaters to be recovered and also makes it possible to limit the amount of tapped-off steam 111 fed to the first set 101 of heaters.

One advantage with such a configuration is that the difference between the temperature of the flow 106 of the first outlet of the cooler 7 and the temperature T5 of the outlet 108 of the second set 102 of exchangers is minimized so as to:

- firstly minimize the amount of steam 111 tapped off at the inlet of the first set 101 of exchangers;
- secondly, make it possible to increase the raw power of the station through the resultant increase in the rate of flow in the final stages of the turbine.

FIG. 3 depicts a schematic diagram of the thermodynamic cycle in saturated steam in an electricity production station according to one particular embodiment in which a first set of exchangers 101 comprises two exchangers LP1 and LP2 and a second set of exchangers 102 comprises two exchangers LP3 and LP4.

More specifically, the thermodynamic cycle illustrated here is that of a station comprising a nuclear power source (not illustrated) and turbines 8, 9, 10, the first being a high-pressure turbine 8, the second being a medium-pressure turbine 9, and the third being a low-pressure turbine 10. Throughout the cycle, the driving fluid, in this instance steam, flows successively through the high-pressure turbine 8, medium-pressure turbine 9 then low-pressure turbine 10. These turbines are able to turn a shaft of an alternator 11 able itself to produce electricity.

Upstream of the thermodynamic cycle, a source of steam, namely for example at least one steam generator 1, feeds the high-pressure module 8 with live steam.

A drier(s)/superheater(s) assembly 2 is located between the high-pressure module 8 and the medium-pressure module 9, said drier(s)/superheater(s) assembly 2 being able to dry and superheat the steam derived from the high-pressure module 8, which steam is generated by the steam generator 1 upstream of said high-pressure module 8. This drier(s)/superheater(s) assembly 2 is also fed with live steam by a pipe taken from the outlet of the steam generator 1 to perform the superheating.

Moreover, on the outlet side of the low-pressure module 10, a pipe feeds steam to a condenser 6 itself associated with a heat sink also known as an external circulation circuit 300. This condenser 6 has the effect of converting steam in gaseous form to liquid.

A water extraction system 4 is positioned on the outlet side of a condenser 6, said water extraction system 4 feeding a water purification system 35.

The flow of water coming from the extraction system 4 and from the water purification system 35 is then split into a first fraction 104 conveyed to a first set 101 of heaters and a second fraction 105 conveyed to a cooler 7.

In this embodiment, the first set 101 of heaters comprises two steam inlets 12 and 14 respectively feeding the first heater LP1 and the second heater LP2. The steam flows 12 and 14 correspond to the incoming steam flows of the first set of heaters 101, but the temperatures of these two inlets differ notably because configuring the heaters in series dictates that heating is performed at an increasing given temperatures gradient. The inlet 111 of FIG. 2 is therefore considered to be a schematic representation that does not take account of the differences in temperature and of state of the steam at the inlets to the heaters.

The two heaters LP1 and LP2 are mounted in cascade in such a way that a fraction of the condensate 17 from the second exchanger LP2 is reinjected into the first exchanger LP1. Some of the heat of the water which is not used by the second heater LP2 is thus recovered. The residual water outlet 18, at a temperature T8, from the first heater is returned to the condenser 6.

The second set 102 of heaters comprises, in this embodiment, a third heater LP3 and a fourth heater LP4. The two heaters of the second set of heaters are mounted in series with respect to the flow of treated water coming from the first set 101 of heaters and respectively allow a transfer of heat between the steam inlets 20 and 21 coming from tappings of the turbine to the extraction water passing through the heaters on its way to a feed tank BA also referred to as a degassing tank used to reduce the concentration of oxygen and other gases contained in the water.

In this example, the third and fourth heaters LP3 and LP4 are mounted in cascade. What that means is that a fraction of the residual water 16 from the fourth exchanger LP4 is reinjected into the third exchanger LP3 to improve the thermodynamic cycle and the thermal efficiency of the heating circuit.

To improve the energy balance, the third LP3 and fourth LP4 heaters each comprise an inbuilt cooler 15 and 15' respectively.

The third LP3 and fourth LP4 heaters are mounted in series with the fifth heater BA which is a mixing exchanger. As an alternative, a contact exchanger can be used without this having any impact on the general scope of the invention.

The second set 102 of exchangers comprises a steam inlet 112 corresponding in flow to the two steam inlets 20 and 21 in the embodiment of FIG. 3.

As with the first set 101 of exchangers, the steam inlets of the second set allow steam to be delivered at different pressures and temperatures. This configuration makes it possible to guarantee an increasing temperature gradient in the second set of heaters and optimize the heating circuit and minimize energy losses.

One advantage of the arrangement of the cooler 7 of the invention is that its installation is dissociated from the first set 101 of heaters which is incorporated into the turbine and condenser structure. Thus, the cooler 7 and the treatment of condensate can be configured in such a way as to benefit from the protective equipment associated with the heater LP3 thereby generating no risk to the turbine.

The cooler 7 also is able to solve another problem specific to the circuit carrying water for heating in a thermal electric power station, notably that of maximizing the flow of water that can be treated by a filtration and polishing system in service.

Specifically, in a certain number of stations, at the outlet for the condenser and therefore the inlet to a system for heating the water circuit there is a device used for purifying the water of a power station, also known as a "polishing system" that filters and removes minerals from the water flowing through the heating system.

This configuration is used in particular for single tube steam generating systems and notably for boiling water reactors for which the water has as far as possible to be rid of solid particles and dissolved salts before it enters the steam generator system in order to limit damaging deposits therein.

In this type of plant, the known alternative which is to use a condensate recovery pump is unacceptable because of the amount of water which would thereby escape the polishing treatment making it impossible to ensure the steam generator system receives the required quality of water. The basic configuration with a cooler 7 in series is commonly used in such instances to guarantee turbine safety and water quality, with an accepted compromise regarding plant efficiency. The cooler of the invention and the fact that it is arranged in the heating system allows turbine safety and water quality to be reconciled with improved energy performance.

In one particular embodiment, the temperatures at the various inlet and outlet points of the equipment are:

T1=20° C.;

T2=85° C.;

T4=85° C.;

T5=95° C.;

T6=30° C.

It is also emphasized that these values come from implementing an embodiment in which the flow of water coming from the water extraction system 4 is split into a first fraction 104 conveyed to the first set 101 of heaters, this first fraction 104 representing substantially 90% of said flow of water coming from the extraction system 4, and a complementary fraction 105 conveyed to the cooler 7, this second fraction 105 then representing substantially 10% of said flow of water coming from the extraction system 4.

Advantageously, the first fraction 104 represents a range of between 85 and 95% of the flow of water coming from the extraction system 4 and the second fraction 105 conveyed to the cooler 7 represents a range of values from between 15 and 5%. These values are in terms of percentages of the flow of water coming from the extraction system (4).

Thanks to the invention, the energy of the condensate from the heater LP3 is thus recovered at a temperature of 85° C., when this same energy would be recovered at a temperature of between 20° C. and 30° C. in the earlier configuration corresponding to the cooler in series. An application of the invention, in this context where the other known solutions are inconceivable because of the risks to turbine safety or feedwater quality, allows a gain of 0.2% in the power produced by the alternator by comparison with the prior art, which is highly significant.

We claim:

1. A heating system for a thermal electric power station water circuit, comprising:

an extraction system for extracting water from a condenser;

a first set of heaters comprising:

at least one heater, a first water inlet providing an extracted-water-for-heating inlet fed with a first fraction of a flow of extracted water coming from the extraction system, and at least one steam input for heating the extracted water;

a second set of heaters comprising:

at least one heater arranged in series with respect to the extracted-water inlet of the first set of heaters, and at least one steam input for heating the extracted water;

a condensate cooler comprising:

a first water inlet providing a condensate inlet fed by a condensate outlet of the second set of heaters, a second water inlet fed with a complementary fraction of the extracted-water flow coming from the extraction system, said second water inlet bypassing the first set of heaters, a first outlet for cooled condensate that is configured to be reinjected into the condenser, and, a second outlet for heated water so that a flow of water leaving the first set of heaters is mixable with a flow of water derived from the second outlet of the condensate cooler; and a regulator 'R' positioned upstream of the second water inlet of the condensate cooler for regulating the extracted water flow coming from the extraction system so as to allow adjustment of the complementary fraction of the extracted water flow fed to the condensate cooler.

2. The heating system as claimed in claim 1, wherein the complementary fraction of the flow of water fed to the cooler represents, in percentage terms, between 2 and 20% of the flow of water coming from the extraction system.

3. The heating system as claimed in claim 1, wherein the complementary fraction of the flow of water fed to the cooler represents, in percentage terms, between 5 and 15% of the flow of water coming from the extraction system.

4. The heating system as claimed in claim 1, wherein the first set of heaters comprises at least one first heater and one second heater which are arranged in cascade so that a fraction of the water heated up by the steam introduced into the second heater is reinjected either into the first heater or into the condenser.

5. The heating system as claimed in claim 1, wherein the second set of heaters comprises at least one third heater and one fourth heater arranged in cascade such that a fraction of the condensate from the steam introduced into the fourth heater is reinjected into the third heater.

6. The heating system as claimed in claim 1, wherein a polishing system is arranged between the extraction system that extracts water from the condenser and the inlet of the first set of heaters so as to filter out particles present and trap salts dissolved in the water that is to be heated in the water circuit.

* * * * *